United States Patent [19]

Arai

[11] 3,964,428

[45] June 22, 1976

[54] INDICATING DEVICE HAVING A PLURALITY OF OVERTURNABLE FLAPS

[75] Inventor: Kiyoyuki Arai, Tokyo, Japan

[73] Assignee: Copal Company Limited, Tokyo, Japan

[22] Filed: Mar. 25, 1975

[21] Appl. No.: 561,995

[30] Foreign Application Priority Data

Mar. 26, 1974 Japan ..... 49-34294[U]

[52] U.S. Cl. ..... 116/129 H; 40/68

[51] Int. Cl.[2] ..... G09F 7/22

[58] Field of Search ..... 116/129 H, 129 R; 40/68.6, 72, 73.4, 77.8, 77.9, 77.4, 68

[56] References Cited

UNITED STATES PATENTS

| | | | |
|---|---|---|---|
| 1,389,078 | 8/1921 | Spinell | 40/77.7 |
| 3,245,616 | 4/1966 | Herrington | 40/68 |

*Primary Examiner*—S. Clement Swisher
*Assistant Examiner*—Denis E. Corr
*Attorney, Agent, or Firm*—Oblon, Fisher, Spivak, McClelland & Maier

[57] ABSTRACT

Indicating device comprising a plurality of overturnable indicating flaps bearing information on both sides thereof and rotatably mounted along the periphery of a rotating drum for indicating necessary information successively by one of the sides of the respective flap after the successive indication has been effected by the other side of the respective flap as the drum rotates, a guide plate having a guide hole for engaging with side edges of the respective flaps so as to guide the flaps with the same oriented in the tangential direction to the circumference of the drum as the drum rotates, a recess being formed in the circular guide hole for permitting the respective flaps to be overturned in the recess as the same is brought into the recess, and an actuating lever capable of engaging the respective flaps when brought into the recess so as to overturn the flaps within the recess. The actuating lever is supported rotatably in the indicating device and urged by a spring against the periphery of the drum so as to insure the positive engagement of the actuating lever with the respective flaps.

6 Claims, 5 Drawing Figures

INDICATING DEVICE HAVING A PLURALITY OF OVERTURNABLE FLAPS

BACKGROUND OF THE INVENTION

The present invention relates to an indicating device having a plurality of overturnable indicating flaps bearing information on both sides thereof and rotatably mounted around the periphery of a rotating drum for indicating successively necessary information such as those of clocks, computors and game machines on one of the sides of the respective flap by successively overturning the flaps after the successive indication by the other side has been completed.

Recently, indicating devices having overturnable indicating flaps as described above have been developed for use with clocks, computors, game machines and the like, because such indicating devices can indicate necessary information in a large dimension thereby facilitating the read out of the indication.

The present invention aims at improving the performance of the indicating devices referred to above, while the construction of the same is kept simple.

SUMMARY OF THE INVENTION

The object of the present invention is to provide a novel and useful indicating device of the type described above which can be operated at higher speed without fail over the prior art indicating device and simple in construction.

The other objects and advantages of the present invention will be apparent from the following description of preferred embodiments thereof when read in connection with the accompanying drawings.

DETAILED DESCRIPTION OF THE PREFERRED EMBODIMENTS

Figure 1:
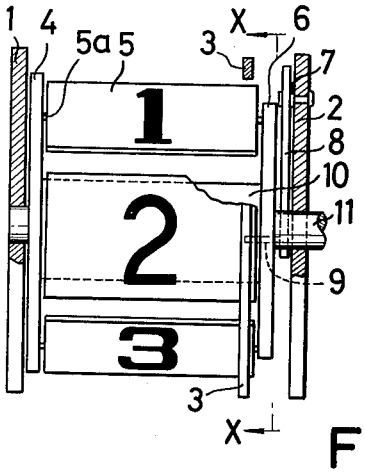
FIG. 1 is a front elevational view partly in section showing an embodiment of the indicating device of the present invention.
Figure 3:
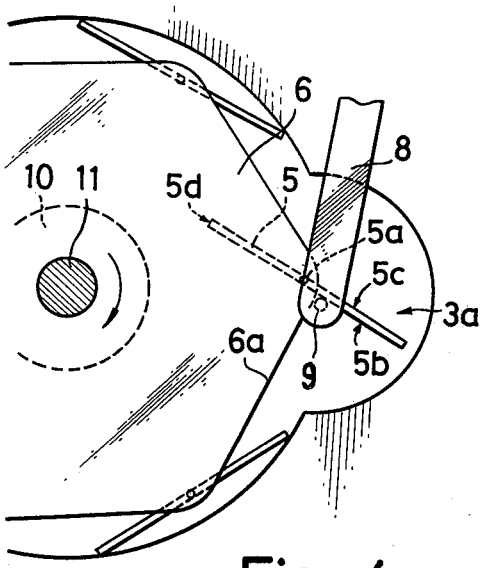
FIG. 3 is a fragmentary view in enlarged scale showing the detail of FIG. 2.
Figure 2:
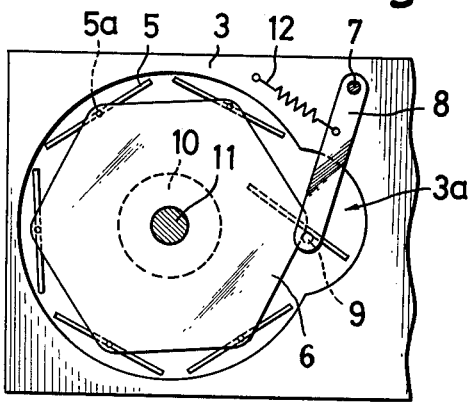
FIG. 2 is a sectional view as seen in the direction X — X in FIG. 1.

Referring to FIGS. 1 – 3 showing an embodiment of the present invention, the side plates 1, 2 of the indicating device rotatably support a drive shaft 11 to which the rotating drum 10 having end flanges 4, 6 is fixedly secured concentrically for rotation therewith.

A plurality of overturnable indicating flaps 5 bearing on both sides thereof necessary information are rotatably mounted along the peripheries of the end flanges 4, 6 by longitudinal central shafts 5a secured to the respective flaps 5.

A guide plate 3 is provided between the side plates 1, 2 adjacent to the end flange 6 of the drum 10. The guide plate 3 is formed with a circular guide hole concentrically positioned with respect to the axis of the drum 10 so that the side edges of the respective flaps 5 parallel to the axis of the drum 10 are guided by the circular guide hole with the flaps being kept oriented tangentially of the circumference of the flanges 4, 6 as the drum 10 rotates.

As seen in FIG. 2, the circular guide hole of the guide plate 3 is formed at a portion thereof with a substantially semi-circular recess 3*a* extending outwardly of the guide hole with the center thereof positioned adjacent to the periphery of the circular guide hole. Thus, the respective flaps 5 are permitted to be overturned in the semi-circular recess 3*a* when the flaps are brought into the recess 3*a*.

As shown in FIGS. 2 and 3, the end flange 6 is in the form of a polygon so as to form a cam plate with the apices thereof being rounded off with a small radius. The shaft 5*a* each of the flaps is rotatably supported at the respective apices of the polygon.

The embodiment shown in FIGS. 1 – 3 is a clock in which six flaps are provided and the first flap, for example, say, bears information 1 on one side while 7 is borne on the opposite side, and the second flap bears 2 on one side while 8 is borne on the opposite side and so on so as to indicate 1 to 6 on the one side of the respective flap while 7 to 12 are indicated by the opposite side of the respective flap. However, the number of flaps may be varied depending upon the information required.

Each of the flaps 5 is shown as having a thin rectangular shape in cross-section, but it may be in the form of spinning spindle in cross-section.

In accordance with the present invention, an actuating lever 8 is swingably mounted on the side plate 2 of the indicating device by a pivot shaft 7, and a laterally extending pin 9 is secured to the free end of the lever 8 which is positioned within the recess 3*a* of the guide plate 3. The pin 9 is preferably positioned in a path passing adjacent to the center of the recess 3*a*. A spring 12 is secured at its one end to a stationary portion (not shown) in the indicating device while the other end is secured to the lever 8 so that the lever 8 is urged in the clockwise direction in FIGS. 2 and 3 thereby slidingly contacting the pin 9 on the periphery of the end flange 6 forming the cam plate as the drum 10 rotates. The pin 9 extends to the extent that it also contacts with the respective flange 5 as it is brought into the recess 3*a*.

The shaft 11 may be rotated continuously or intermittently.

In operation, when the drum 10 is rotated in the direction indicated by the arrow in FIG. 3, one of the flaps 5 is brought into the recess 3*a* after it is guided by the circular guide hole of the guide plate 3. Thus, the pin 9 which slidingly contacts with the periphery of the end flange 6 comes into contact with the inwardly facing side 5*b* of the flap 5 so that the flap 5 is rotated about its shaft 5*a* in the anticlockwise direction and, after the shaft 5*a* passes beyond the center of the recess 3*a*, the flap 5 is rotated by about 180° so that the side 5*b* of the flap 5 which has been facing inwardly of the drum 10 is exposed outwardly so as to indicate the information borne on that side 5*b*. After the flap 5 is rotated by 180°, the now leading edge 5*d* of the flap 5 and, then, the trailing edge thereof are engaged with the circular guide hole of the guide plate 3 so that the flap 5 is guided thereby with the flap 5 being oriented tangentially of the periphery of the flange 6 and the side 5*c* facing inwardly of the drum 10 as the drum 10 rotates in the manner as previously described, and the same operation is repeated for the succeeding flaps. To this end, the size and shape of the recess 3*a* is appropriately selected.

An indicating window (not shown) is provided at the position opposite to the position at which the recess 3*a* is located, for example, so that the display of the information by the flap located at the window may be effected through the window.

The force of the spring 12 is selected so that the rotation of the drum 10 is insured while positive contact of the pin 9 with the periphery of the flange 6 is maintained.

As described above, since the pin 9 of the actuating lever 8 is positively and yieldingly contacted slidingly by means of the spring 12 with the periphery of the end flange 6 forming the cam plate, the flap 5 can be positively caught by the pin 9 and overturned by the pin 9.

In the embodiment shown in FIGS. 1 – 3, the drum 10 can be rotated in the opposite direction without deteriorating the operation of the indicating device.

Figure 4:
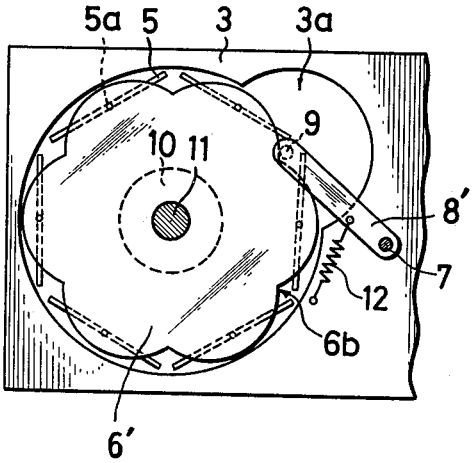
FIG. 4 is a sectional view similar to FIG. 2 but showing another embodiment of the present invention.

FIG. 4 shows an alternative embodiment of the present invention.

In the embodiment shown in FIG. 4, the end flange 6' of the drum 10 forming the cam plate is in the form of a petal in which a plurality of arcuate portions are arranged around the flange 6' with the recessed points 6*b* joining the adjacent two arcuate portions being positioned intermediate the pivot points of the shafts 5*a* as shown.

This form of the flange 6' not only permits the drum 10 to be rotated in either of the opposite directions without deteriorating the operation of the indicating device, but also the recessed points 6*b* can be utilized as click means by which the drum 10 can be snappingly arrested by the pin 9 so as to hold the drum 10 in position for the indication. In this case, the driving of the drum 10 can be effected by an appropriate intermittent driving means (not shown) instead of providing the drive shaft 11, and the stopping of the drum 10 in position is effected by the cooperation of the recessed points 6*b* with the pin 9. A leaf spring (not shown) serving as click means may be provided which cooperates with the recessed points 6*b* so as to insure the positive arresting in position of the drum 10.

Figure 5:
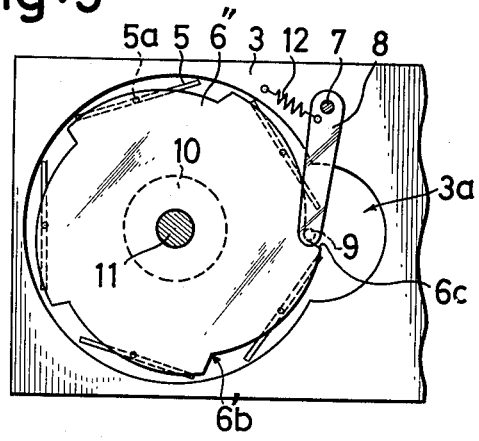
FIG. 5 is a sectional view similar to FIG. 2 but showing a still further embodiment of the present invention.

FIG. 5 shows a still further embodiment of the present invention. In this embodiment, the periphery of the flange 6'' forming the cam plate is in the serrated form having steep sloping sides 6*c* connecting the adjacent easy or slow sloping sides. In this case, the recessed points 6'*b* serve also as click means cooperating with the pin 9. Although the rotation of the drum 10 in this embodiment is limited to one direction, the steep sloping sides 6*c* serve as signal generating means cooperating with the lever 8. In other words, the lever 8 is quickly moved as the pin 9 slides downwardly along the steep sloping sides 6*c* during the rotation of the drum 10 so that an electric signal can be generated by an electromagnetic means by utilizing this quick movement of the lever 8. This is particularly useful when the drum 10 is rotated by an electric motor, because such signals can be utilized as motor stopping signals. Thus, the motor is stopped by the stopping signal and the drum 10 is positively arrested in position by the pin 9 engaging with the recessed points 6'*b*.

The configuration of the cam plate can be variously modified other than as shown in the drawings.

Further, the location of the recess 3*a* can be altered to any appropriate position with respect to the indicating window.

The indicating device of the present invention can be used in any desired orientation of the indicating device.

I claim:

1. Indicating device comprising a plurality of overturnable indicating flaps rotatably mounted by their longitudinal central shafts along the periphery of a rotating drum, said flaps having indicating surfaces at their both sides, respectively, a guide plate located adjacent to one end of said drum and having a circular guide hole concentrically positioned with respect to the axis of said drum so as to engage at its inner periphery with side edges of the respective flaps which are parallel to the axis of said drum thereby guiding said flaps with the flaps being kept oriented in the tangential direction to the circumference of said drum as said drum rotates, said circular guide hole being formed at a portion thereof with a recess extending outwardly of the inner periphery of said circular guide hole so as to permit the respective flaps to be overturned about their longitudinal central shafts within said recess when the flaps are brought in succession to said recess as said drum rotates, an actuating lever pivotally supported by one end thereof upon a stationary portion of said indicating device and positioned adjacent to said one end of said drum so as to be swung in a plane parallel to said one end of said drum with the free end terminating within said recess, said actuating lever being formed with a lateral projection at its free end adapted to engage with the periphery of said one end of said drum within said recess as well as with the respective flaps when brought into said recess, and a spring connected between a stationary portion of said indicating device and said actuating lever so as to urge said lateral projection against the periphery of said one end of said drum in sliding contact therewith, thereby permitting said lateral projection to abut against the respective flaps in succession as said drum rotates so that the respective flap is positively overturned in said recess for exposing the indicating surface thereof which had been faced toward the interior of said drum.

2. Indicating device according to claim 1, wherein said drum is intermittently rotated so as to insure steady indication by the respective flap.

3. Indicating device according to claim 1, wherein the periphery of said one end of said drum with which said lateral projection slidingly contacts is in the form of a polygon to form a cam plate with the epices being rounded off with a small radius and the longitudinal central shaft of each of said flaps being rotatably supported at the respective apex of said polygon, said lateral projection of said actuating lever being brought into contact with the side of the respective flap facing toward the interior of said drum as the flap moves into said recess by virtue of said lateral projection being yieldably urged against the periphery of said polygon by means of said spring thereby insuring the positive overturn of the respective flap in said recess as said drum rotates while said drum can be rotated in either of the opposite two directions without deteriorating the operation of said indicating device.

4. Indicating device according to claim 2, wherein the periphery of said one end of said drum with which said lateral projection slidingly contacts is in the form of a petal in which a plurality of arcuate convex portions are serially arranged in the circumferential direction of said drum with the recessed points joining the adjacent two arcuate portions being positioned intermediate the portions at which the respective longitudinal central shafts of said flaps are rotatably supported, thereby permitting the drum to be releasably arrested in position when said lateral projection of said actuating lever snappingly falls into the respective recessed point as said drum rotates so as to insure steady indication by the flaps, while said drum can be rotated in either of the opposite two directions without deteriorating the operation of said indicating device.

5. Indicating device according to claim 4, wherein a further click means is provided which snappingly engages with one of said recessed points as said drum is intermittently rotated so as to positively arrest said drum, thereby insuring the steady indication by the flaps.

6. Indicating device according to claim 2, wherein the periphery of said one end of said drum is in the serrated form having steep sloping sides located intermediate the positions at which the longitudinal central shafts of said flaps are rotatably supported, thereby permitting said drum to be snappingly arrested when said lateral projection falls into the respective recess of said serrated form after sliding along said steep side of said serrated form for steady indication by the flaps, while a signal indicating the correct stopping position of said drum is generated by a sensor operably coupled with the movement of said actuating lever as said lateral projection slides along said steep side of said serrated form.

* * * * *